US006449902B1

(12) United States Patent
Tumin

(10) Patent No.: US 6,449,902 B1
(45) Date of Patent: Sep. 17, 2002

(54) WINDOW SHUTTER UNIT WITH LOCKING MECHANISM

(76) Inventor: Bruce John Tumin, P.O. Box 936585, Margate, FL (US) 33093-6585

( * ) Notice: Subject to any disclaimer, the term of this patent is extended or adjusted under 35 U.S.C. 154(b) by 0 days.

(21) Appl. No.: 09/580,837

(22) Filed: May 30, 2000

Related U.S. Application Data

(63) Continuation-in-part of application No. 09/219,154, filed on Dec. 22, 1998, now abandoned.

(51) Int. Cl.[7] ..... E05B 65/04
(52) U.S. Cl. ..... 49/63; 49/449; 49/354
(58) Field of Search ..... 49/55, 56, 57, 49/63, 62, 362, 372, 374, 354, 348, 449, 61

(56) References Cited

U.S. PATENT DOCUMENTS 1,045,279 A 11/1912 Gradick, Sr.
1,528,131 A 3/1925 Price
1,591,497 A 7/1926 Reeves
2,720,393 A 10/1955 Valentine

FOREIGN PATENT DOCUMENTS

DE 42732 * 3/1888 ..... 49/63
DE 2845302 11/1980

* cited by examiner

*Primary Examiner*—Jerry Redman
(74) *Attorney, Agent, or Firm*—Stephen R. Greiner

(57) ABSTRACT

A window shutter unit with a locking mechanism including a frame for mounting upon a wall in surrounding relation to a window and a panel movably supported by the frame. The panel has a vertically oriented rack and an aperture at the bottom of the rack. A rotatable and longitudinally movable shaft is positioned in a passageway through the wall beneath the window. The shaft has a pinion gear for engaging the rack. Rotational movement of the shaft selectively raises or lowers the panel within the frame. Longitudinal movement of the shaft, however, positions the pinion gear within the aperture so as to selectively lock the panel in a raised position.

9 Claims, 1 Drawing Sheet

WINDOW SHUTTER UNIT WITH LOCKING MECHANISM

This application is a continuation-in-part of the application, Ser. No. 09/219,154, filed Dec. 22, 1998, now abandoned.

FIELD OF THE INVENTION

The present invention relates generally to movable or removable closures and, more particularly to facially opposed primary and auxiliary closures for a common opening in a building structure.

BACKGROUND OF THE INVENTION

Various news outlets reported recently that a blaze started in a home's living room. When awakened, one victim broke a bedroom window in an attempt to escape only to find his passage blocked by an aluminum storm shutter. Trapped, he was soon overcome by smoke and died. In preparing for hurricane force winds, a homeowner overlooked another danger—fire.

It is well known that conventional shutters must be opened by one positioned outside a building. While such shutters are adequate to protect the windows of a home or other building structure from damage during violent storms, they lack quick-release mechanisms permitting the escape of building occupants in emergencies. Therefore, a need presently exists for a window shutter unit that may be locked closed against the forces of a storm yet that allows building occupants to quickly uncover a window and easily pass through during emergencies, such as fires, which require immediate exit to avoid serious injury or death.

SUMMARY OF THE INVENTION

In light of the problems associated with the known storm shutters, it is a principal object of the invention to provide a window shutter unit which can be locked in a closed position to cover and protect a window of a building structure during a storm yet can be easily unlocked and opened to permit the passage of building occupants in the event of an emergency.

It is another object of the invention to provide a window shutter unit of the type described which may be permanently mounted on a building structure so that it is always accessible and ready for use in the event of a severe storm.

It is a further object of the invention to provide a window shutter unit that may be easily installed on both existing building structures and those contemplated for future construction.

It is an object of the invention to provide improved elements and arrangements thereof in a window shutter unit for the purposes described which is lightweight in construction, inexpensive to manufacture, and fully dependable in use.

Briefly, the window shutter unit in accordance with this invention achieves the intended objects by featuring a frame for mounting upon a wall in surrounding relation to a window and a panel movably supported by the frame. The panel has a vertically oriented rack and an aperture beneath the rack. A rotatable and longitudinally movable shaft with a pinion gear at one end is positioned in the wall beneath the window. Rotating the shaft selectively raises or lowers the panel within the frame. Also, longitudinally moving the shaft positions the pinion within the aperture to selectively lock the panel in a raised position.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

Similar reference characters denote corresponding features consistently throughout the accompanying drawings.

DETAILED DESCRIPTION OF THE PREFERRED EMBODIMENT

Figure 1:
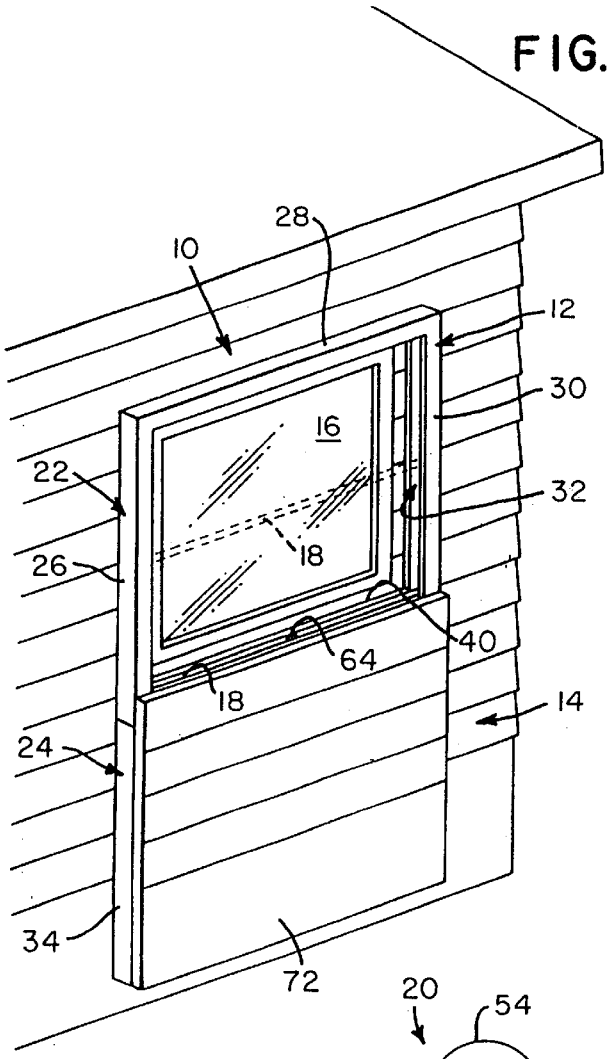
FIG. 1 is an environmental perspective view of a window shutter unit with a locking mechanism in accordance with the present invention.
Figure 2:
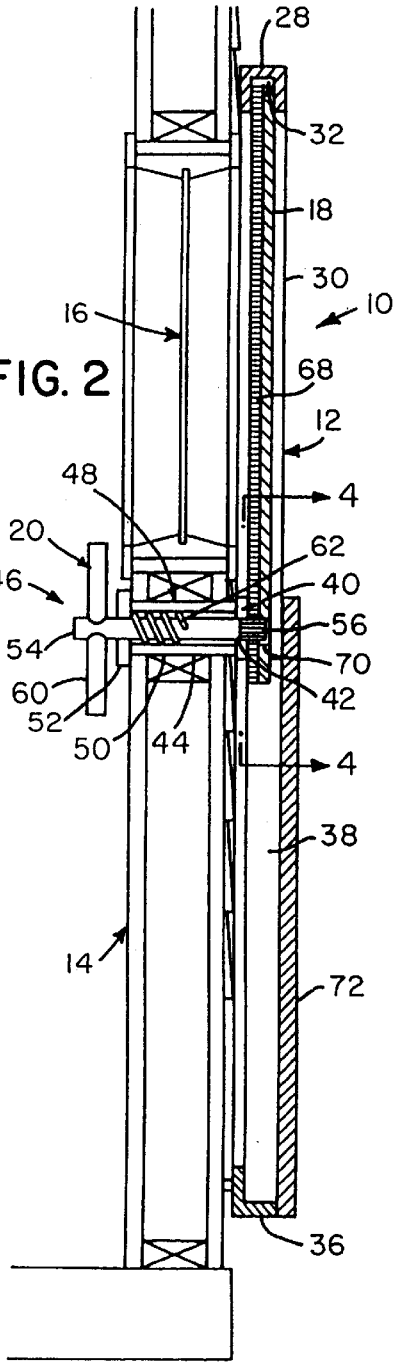
FIG. 2 is a vertical, cross-sectional view of the window shutter unit.
Figure 3:
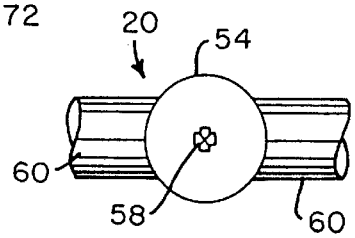
FIG. 3 is an end view of the hand crank of the invention.
Figure 4:
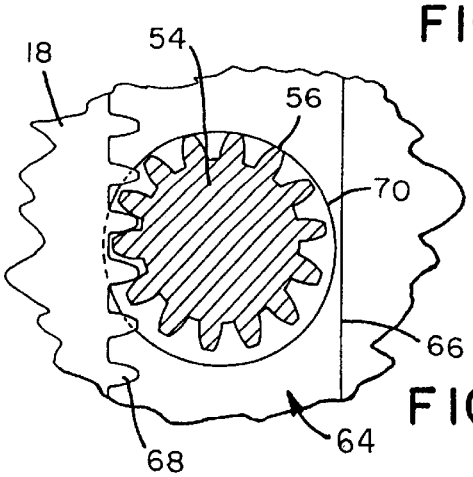
FIG. 4 is a cross-sectional view taken on line 4—4 of FIG. 2.

Referring now to the FIGS., a window shutter unit with a locking mechanism in accordance with the present invention is shown at 10. The shutter unit 10 includes a rectangular frame 12 for mounting upon an exterior building wall 14 in surrounding relation to a window 16. Supported by the frame 12 is a movable panel 18 which may be elevated by means of a hand crank 20 from a lowered storage position shown by solid lines in FIG. 1, through an intermediate position shown by broken lines in FIG. 1, to an elevated window-covering position shown in FIG. 2. In an emergency, the hand crank 20 may be disengaged from the panel 18 in its elevated position so as to permit the panel to rapidly fall under the influence of gravity to its lowered position.

The frame 12 preferably has an upper portion 22 and a lower portion 24 of substantially equal size. The upper portion 22 is formed of C-shaped members 26, 28 and 30 each of which defining an interior channel 32 for slidably receiving the panel 18. The lower portion 24, however, is suspended from the upper portion 22 and is constructed from L-shaped members 34, 36 and 38. Thus, the front of the lower portion 24 is open, at least during initial assembly of unit 10, for the easy receipt and withdrawal of the panel 18.

The frame 12 is provided with a crossbar 40 which connects the bottoms of the C-shaped members 26 and 30 together. The center of the crossbar 40 is provided with an aperture 42 for axial alignment with a hole 44 passing through the wall 14 beneath the window 16. Because the crossbar 40 is positioned to the rear of the channel 32, it does not impede movement of the panel 18.

Supported by the wall 14 adjacent the crossbar 40 is a hand crank assembly 46. The assembly 46 includes a crank housing 48 movably supporting the hand crank 20. The housing 48 has a tubular body 50 dimensioned to extend snugly through the hole 44 and a collar 52 affixed to the end of the body 50 remote from the crossbar 40. The collar 52 has a larger diameter than that of the hole 44 and, therefore, serves as a stop to prevent the passage of the body 50 outwardly through the hole 44.

The hand crank 20 includes an elongated shaft 54 rotatably carried by the body 50. One end of the shaft 54 normally extends through the aperture 42 in the crossbar 40 and is provided with a number of radially outwardly directed teeth 56 which define a pinion gear. The opposite end of the shaft 54 is provided with a socket 58 for receiving the head of a screwdriver (not shown). Adjacent the socket 58, lever arms 60 for manual rotation of the crank 20 extend outwardly from the shaft 54.

Interposed between the tubular body 50 and shaft 54 is a compressed spring 62. As shown, one end of the spring 62 is affixed to the collar 52 and the other end thereof is affixed to the shaft 54 at a location near the teeth 56. Thus, the spring 62 tends to urge the shaft 54 outwardly from the hole 44 and into engagement with the panel 18.

The panel 18 is preferably rectangular in outline and is formed from a suitably durable material. The rear surface of the panel 18 is provided with a vertically oriented depression or groove 64 which is aligned with the shaft 54 so as to receive the pinion gear formed by teeth 56 thereon. Preferably, one side 66 of the groove 64 is planar and smooth whereas the other side thereof is provided with a plurality of teeth 68 along its length which form a rack. The teeth 68 are adapted to mesh with the teeth 56 of the crank 20 so that, by rotating the crank 20, the panel 18 may be selectively raised and lowered.

The panel 18 is provided with an aperture 70 within the bottom of the groove 64. The aperture 70 is sized to receive the teeth 56 of the crank 20. Thus, when the panel 18 is in an elevated position, the shaft 54 may be partially inserted into the aperture 70 thereby preventing the inadvertent lowering of the panel 18. Of course, the panel 18 may be rapidly lowered at any time by pulling the crank 20 against the force of the compressed spring 62 to withdraw the teeth 56 from the aperture 70. Gravity will then lower the panel 18.

To reduce the rate of weathering of the panel 18 when in a lowered position, the frame 12 is provided with a cover plate 72 formed of a weather-resistant material. The cover plate 72 is fastened by means of threaded fasteners (not shown) along its side and bottom edges to the front edges of L-shaped members 34, 36 and 38. If necessary, the cover plate 72 can be removed from the remainder of the frame 12 for servicing the panel 18 or hand crank assembly 46.

Use of the shutter unit 10 is straightforward. After installation on wall 14 as shown in the FIGS., rotating the crank 20 may elevate the panel 18. Rotation of the crank 20 may be accomplished by manually pulling on the lever arms 60 or by engaging the fitting of an electrically powered screwdriver (not shown) with the socket 58 and energizing the screwdriver. When the panel 18 reaches its fully elevated position, the spring 62 will automatically drive the teeth 56 of the shaft 54 into the aperture 70 to lock the panel 18 in place. When it is desired to fully lower the panel 18, as in an emergency situation, a light tug on the lever arms 60 against the pull of the spring 62 will permit the panel 18 to fall into the lower portion 24 of the frame 12. Thus, safe and rapid passage from the window 16 outfitted with the shutter unit 10 can be readily obtained.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A window shutter unit with a locking mechanism, comprising:

a frame for mounting upon a wall in surrounding relation to a window in the wall;

a movable panel being supported by said frame and being selectively movable between a raised position for covering the window and a lowered position beneath the window, said panel having opposed, front and back sides and an aperture penetrating the bottom of said back side;

a vertically oriented rack affixed to said back side of said movable panel and having a bottom end positioned adjacent said aperture in said back side of said movable panel;

a tubular body for positioning within a wall beneath a window, said tubular body being located adjacent said back side of said movable panel, said tubular body defining a passageway being in axial alignment with said aperture in said movable panel when said movable panel is in said raised position;

a shaft being rotationally and longitudinally movable within said passageway of said tubular body, said shaft having opposed, inner and outer ends;

a lever arm secured to said inner end of said shaft for rotating and longitudinally moving said shaft; and, a pinion gear being affixed to said outer end of said shaft and being adapted for selective engagement with said rack for elevating said panel to said raised position and selective positioning within said aperture in said movable panel wherein longitudinal movement of said shaft away from said back side of said movable panel will disengage said pinion gear from said rack permitting said movable panel to fall under the influence of gravity to said lowered position within said frame and selective longitudinal movement of said shaft toward said back side of said movable panel when such is in said raised position will drive said pinion gear into said aperture locking said movable panel in said raised position.

2. The window shutter unit with a locking mechanism according to claim 1 further comprising a cover plate being affixed to the bottom of said frame for concealing said front side of said movable panel when said movable panel is in said lowered position.

3. The window shutter unit with a locking mechanism according to claim 1 further comprising a compressed spring for urging said pinion gear into said aperture in said movable panel, said spring being positioned within said tubular body and having opposed ends, one of said opposed ends being affixed to said shaft and the other one of said opposed ends abutting an end of said tubular body.

4. The window shutter unit with a locking mechanism according to claim 1 wherein said inner end of said shaft is provided with a socket adapted to receive a fitting of a power tool for rotating said shaft.

5. A window shutter unit with a locking mechanism, comprising:

a rectangular frame for mounting upon a wall in surrounding relation to a window in the wall, said frame having first opposite sides and a channel in each of said first opposite sides;

a movable panel having second opposite sides each being slidably positioned within a corresponding one of said channels and being selectively movable between a raised position for covering the window and a lowered position beneath the window, said movable panel having a height which is substantially equal to one-half the height of said rectangular frame, said movable panel having opposed, front and back sides and a vertically-oriented groove with a toothed side defining a rack and an aperture in the bottom of said groove; and, a hand crank assembly for selectively raising and lowering said panel, said hand crank assembly including:

a tubular body for fastening within the wall beneath the window, said tubular body being located adjacent said back side of said movable panel, said tubular body defining a passageway being in axial alignment with said aperture in said movable panel when said movable panel is in said raised position;

a hand crank including:

a shaft being rotationally and longitudinally movable within said passageway of said tubular body, said shaft having opposed, inner and outer ends;

a lever arm secured to said inner end of said shaft for rotating and a pinion gear being affixed to said outer end of said shaft and being adapted for to mesh with said toothed side of said groove for elevating said panel to said raised position and selective positioning within said aperture in said movable panel wherein longitudinal movement of said shaft away from a said back side of said movable panel will disengage said opinion gear from said toothed side of said groove permitting said movable panel to fall under the influence of gravity to said lowered position within said frame and selective longitudinal movement of said shaft toward said back side of said movable panel when such is in said raised position will drive said pinion gear into said aperture locking said movable panel in said raised position; and, a compressed spring for urging said pinion gear into said groove and said aperture in said movable panel, said spring being positioned within said tubular body and having opposed ends, one of said opposed ends being affixed to said shaft and the other one of said opposed ends abutting an end of said tubular body.

6. The window shutter unit with a locking mechanism according to claim 5 wherein said shaft has a socket in said inner end thereof adapted to receive a fitting of a power tool for rotating said shaft.

7. The window shutter unit with a locking mechanism according to claim 5 further comprising a cover plate being affixed to the bottom of said frame for concealing said front side of said movable panel when said movable panel is in said lowered position.

8. A window shutter unit with a locking mechanism, comprising:

a rectangular frame having:

an upper portion formed from a plurality of C-shaped members each of which defining an interior channel;

a lower portion suspended from said upper portion and formed from a plurality of L-shaped members;

a crossbar secured to the back of said upper portion and connecting the bottoms of said C-shaped members together, said crossbar having a first aperture in the center thereof; and, a cover plate secured to the front of said lower portion and covering the lower half of said rectangular frame;

a movable panel having opposite sides each of which being slidably positioned within a corresponding one of said interior channels and being selectively movable between a raised position for covering the window and a lowered position beneath the window, said movable panel having opposed, front and back sides and a vertically-oriented groove with a toothed side defining a rack and a second aperture in the bottom of said groove;

a hand crank assembly for selectively raising and lowering said panel, said hand crank assembly including:

a tubular body for fastening within the wall beneath the window, said tubular body being located adjacent said back side of said movable panel, said tubular body defining a passageway being in axial alignment with said first aperture in said crossbar and said second aperture in said movable panel when said movable panel is in said raised position;

a hand crank including:

a shaft being rotationally and longitudinally movable within said passageway of said tubular body, said shaft having opposed, inner and outer ends;

a lever arm secured to said inner end of said shaft for rotating and longitudinally moving said shaft;

a pinion gear being affixed to said outer end of said shaft and being adapted for to mesh with said toothed side of said groove for elevating said panel to said raised position and selective positioning within said second aperture in said movable panel wherein longitudinal movement of said shaft away from said back side of said movable panel will disengage said pinion gear from said toothed side of said groove permitting said movable panel to fall under the influence of gravity to said lowered position within said frame and selective longitudinal movement of said shaft toward said back side of said movable panel when such is in said raised position will drive said pinion gear into said second aperture locking said movable panel in said raised position; and, a compressed spring for urging said pinion gear into said groove and said second aperture in said movable panel, said spring being positioned within said tubular body and having opposed ends, one of said opposed ends being affixed to said shaft and the other one of said opposed ends abutting an end of said tubular body.

9. The window shutter unit with a locking mechanism according to claim 8 wherein said shaft has a socket adjacent said lever arm adapted to receive a power tool for rotating said shaft.

* * * * *